US010695609B2

(12) United States Patent
Anastasi et al.

(10) Patent No.: US 10,695,609 B2
(45) Date of Patent: Jun. 30, 2020

(54) PULL UP ACCESSORY

(71) Applicants: Joseph P. Anastasi, Carle Place, NY (US); Brian Cohen, Westbury, NY (US)

(72) Inventors: Joseph P. Anastasi, Carle Place, NY (US); Brian Cohen, Westbury, NY (US)

( * ) Notice: Subject to any disclaimer, the term of this patent is extended or adjusted under 35 U.S.C. 154(b) by 108 days.

(21) Appl. No.: 15/682,954

(22) Filed: Aug. 22, 2017

(65) Prior Publication Data

US 2019/0060706 A1 Feb. 28, 2019

(51) Int. Cl.

| | |
|---|---|
| ***A63B 23/12*** | (2006.01) |
| ***A63B 21/00*** | (2006.01) |
| ***A63B 21/068*** | (2006.01) |
| ***A63B 1/00*** | (2006.01) |

(52) U.S. Cl.

CPC .... *A63B 23/1218* (2013.01); *A63B 21/00047* (2013.01); *A63B 21/068* (2013.01); *A63B 21/4035* (2015.10); *A63B 1/00* (2013.01); *A63B 2209/00* (2013.01); *A63B 2210/50* (2013.01); *A63B 2225/09* (2013.01)

(58) Field of Classification Search

CPC ..... A63B 23/12; A63B 21/40; A63B 21/06; A63B 21/00

See application file for complete search history.

(56) References Cited

U.S. PATENT DOCUMENTS

| | | | | |
|---|---|---|---|---|
| 3,380,447 | A * | 4/1968 | Martin | A61H 1/0218 482/144 |
| 4,807,876 | A * | 2/1989 | Lothar | A63B 71/00 482/106 |
| 4,858,917 | A * | 8/1989 | Montgomery | A63B 21/0602 482/106 |
| 4,911,434 | A * | 3/1990 | Herring | A63B 21/065 482/105 |
| 5,169,364 | A * | 12/1992 | Donaldson | A63B 21/065 482/105 |
| 5,628,714 | A * | 5/1997 | Philipson | A63B 21/0552 482/102 |
| 5,947,875 | A * | 9/1999 | Cone | A47D 13/043 482/143 |
| 6,338,702 | B1 * | 1/2002 | Jordan | A63B 21/072 294/15 |
| 6,715,728 | B2 * | 4/2004 | Nielsen | A63B 21/4035 224/268 |
| D518,534 | S * | 4/2006 | Giordano | D21/662 |
| 7,066,866 | B1 * | 6/2006 | Mobley | A63B 1/00 482/40 |
| 7,540,831 | B2 * | 6/2009 | Hauser | A63B 1/00 482/40 |
| 7,566,292 | B1 * | 7/2009 | Hauser | A63B 1/00 16/422 |

(Continued)

*Primary Examiner* — Garrett K Atkinson

(74) *Attorney, Agent, or Firm* — Tutunjian & Bitetto, P.C.

(57) ABSTRACT

A pull up accessory that removably clips onto an existing pull up bar and provides one or more different hand positions for performing pulls ups or chin ups. An upper portion clips onto the existing bar, and a lower hand engaging portion is provided that is substantially transverse to the existing bar. A locking rotation mechanism can be included that allows the lower hand engaging portion to rotate with respect to the upper bar engaging portion in predetermined increments.

4 Claims, 8 Drawing Sheets

(56) References Cited

U.S. PATENT DOCUMENTS 7,670,271 B2 * 3/2010 Finch ..... A63B 21/00047 482/140
7,762,409 B2 * 7/2010 Vickroy ..... A47G 25/0692 211/113
7,946,967 B2 * 5/2011 Berhanu ..... A63B 21/072 482/109
8,403,818 B1 * 3/2013 Wilkinson ..... A63B 21/00069 482/121
8,777,816 B2 * 7/2014 Grafman ..... A63B 71/14 482/104
8,864,638 B2 * 10/2014 Ross ..... A63B 21/1636 482/141
8,979,717 B2 * 3/2015 Glickstein ..... A63B 21/068 482/143
9,017,232 B2 * 4/2015 Olivarez ..... A63B 21/072 482/104
9,757,604 B2 * 9/2017 Carter ..... A63B 21/1645
9,950,206 B2 * 4/2018 Biddix, Jr. ..... A63B 21/4035
9,999,802 B2 * 6/2018 Kilmon ..... A63B 7/00
10,245,460 B2 * 4/2019 Hetrick ..... A63B 21/068
10,252,099 B2 * 4/2019 Karpachevskyy ..... A63B 21/1636
2005/0113221 A1 * 5/2005 Dovner ..... A63B 21/0004 482/121
2007/0149369 A1 * 6/2007 Finch ..... A63B 21/00047 482/140
2009/0111661 A1 * 4/2009 Hauser ..... A63B 1/00 482/40
2009/0203508 A1 * 8/2009 Hauser ..... A63B 1/00 482/139
2010/0062911 A1 * 3/2010 Stone ..... A63B 21/065 482/92
2010/0144501 A1 * 6/2010 Berhanu ..... A63B 21/072 482/139
2011/0256992 A1 * 10/2011 Grafman ..... A63B 71/14 482/139
2012/0302410 A1 * 11/2012 Kitchens ..... A63B 21/00047 482/96
2013/0012360 A1 * 1/2013 Stone ..... A63B 21/002 482/23
2013/0165298 A1 * 6/2013 Demsey ..... A63B 21/00047 482/40
2013/0172157 A1 * 7/2013 Glickstein ..... A63B 21/068 482/96
2013/0303348 A1 * 11/2013 Cardin ..... A63B 21/0724 482/139
2014/0005015 A1 * 1/2014 Hester ..... A63B 21/154 482/131
2014/0073496 A1 * 3/2014 Bannerman ..... 482/139
2014/0110545 A1 * 4/2014 Goett ..... A63B 21/0442 248/218.4
2016/0008651 A1 * 1/2016 MacInnis ..... A63B 21/062 482/99
2016/0256720 A1 * 9/2016 Grant ..... A63B 21/1636
2016/0303419 A1 * 10/2016 Karpachevskyy ..... A63B 21/1636
2017/0120099 A1 * 5/2017 Biddix, Jr. ..... A63B 21/4035
2018/0021626 A1 * 1/2018 Kilmon ..... A63B 7/00 482/23
2018/0126212 A1 * 5/2018 Souffrain ..... A63B 1/00
2018/0126214 A1 * 5/2018 Biddix, Jr. ..... A63B 21/4035
2018/0140886 A1 * 5/2018 Hetrick ..... A63B 21/068
2018/0185693 A1 * 7/2018 Thurston ..... A63B 71/0054
2018/0250545 A1 * 9/2018 Nunez ..... A63B 21/0557
2019/0099634 A1 * 4/2019 Sanseverino .... A63B 21/00185

* cited by examiner

PULL UP ACCESSORY

BACKGROUND

Technical Field

The present invention relates to pull ups or chin ups. More particularly, it relates to an accessory that removably clips onto a pull up bar and provides one or more different hand positions for performing pulls ups or chin ups.

Description of the Prior Art

A pull up is performed when your hands are facing away from you, while a chin up is performed when your handed are facing toward you. The performance of the standard position of a pull up, i.e., with your hands facing away from you, can put a lot of stress on the athlete's forearms, as you pull up to the bar. This stress can cause athlete injuries and is primarily due to the fixed nature of the bar, relative to the user's hand position and arm position during the pull up motion.

SUMMARY OF THE INVENTION

It is an aspect of the present invention to provide the athlete with a pull up accessory that removes the forearm and other stresses that occur during a pull up motion.

These and other aspects are achieved in accordance with the present invention by providing a pull up accessory having a bar engaging portion and a hand engaging portion. Supports connect the hand engaging portion to the bar engaging portion, where at least one of the supports include a releasable clip. A friction increasing means us positioned on the bar engaging portion and is configured to increase friction between the bar engaging portion and the pull up bar. A twisting preventing means is integrated into the friction increasing means and is configured to maintain the bar engaging portion in a position substantially transverse to the pull up bar.

In accordance with other aspects of the invention, the hand engaging portion is rotatable with respect to the bar engaging portion. A locking rotation mechanism is configured to enable the hand engaging portion to rotate and lock into predetermined increments with respect to the bar engaging portion.

According to another embodiment, the pull up accessory includes a bar engaging portion, a hand engaging portion rotatably connected to the bar engaging portion, and twisting preventing means attached to the bar engaging portion and configured to maintain the bar engaging portion in a position substantially transverse to the pull up bar.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

The present principles are directed to a pull up accessory that provides variations to the user in their pull up fitness routines.

The present description illustrates the present principles. It will thus be appreciated that those skilled in the art will be able to devise various arrangements that, although not explicitly described or shown herein, embody the present principles and are included within its spirit and scope.

All examples and conditional language recited herein are intended for pedagogical purposes to aid the reader in understanding the present principles and the concepts contributed by the inventor(s) to furthering the art, and are to be construed as being without limitation to such specifically recited examples and conditions.

Moreover, all statements herein reciting principles, aspects, and embodiments of the present principles, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

Figure 1:
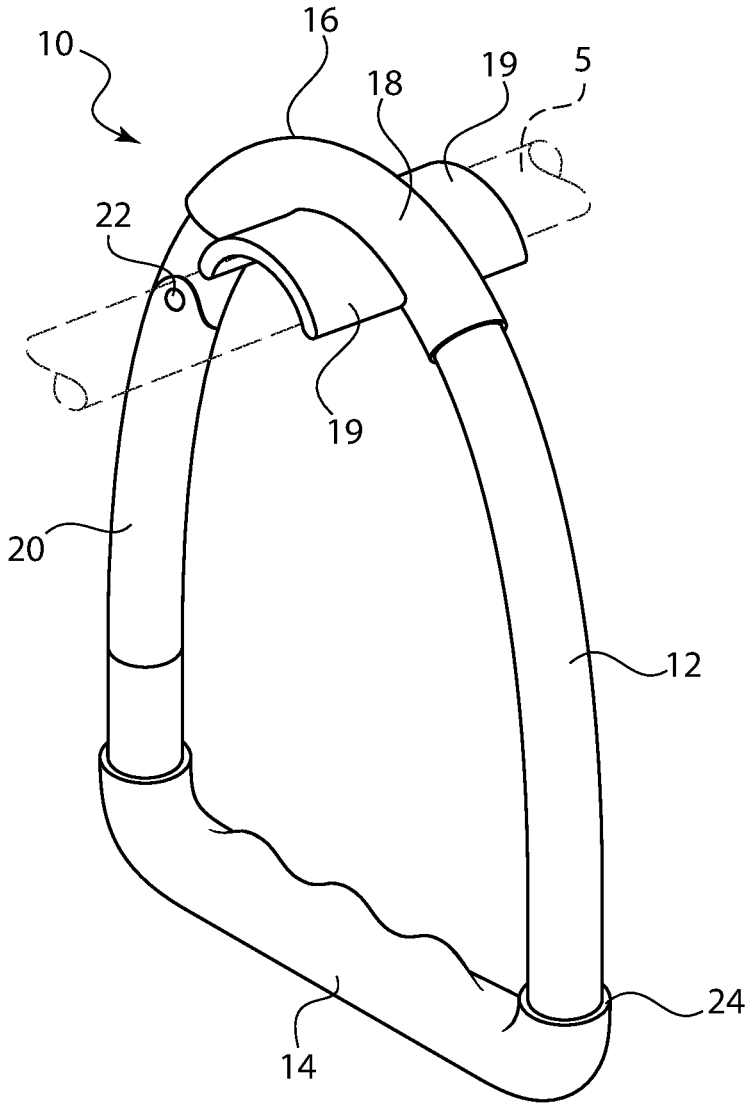
FIG. 1 is a perspective view of the pull up accessory, according to an embodiment of the invention.

FIG. 1 shows the pull up accessory 10 according to one embodiment of the invention. Throughout the following description applicant discusses one pull up accessory, but it will be appreciated that one is needed for each user hand, unless of course the user decides to do single arm pull ups. As shown the accessory 10 includes a lower hand engaging portion 14, and upper bar engaging portion 16 and supports 12 extending from the power hand engaging portion 14 to the upper bar engaging portion 16. On one side, the support 12 is made of a hinge 22 and a hinge member/support 20. The upper bar engaging portion 16 includes a friction increasing/twist preventing portion 18 that has extensions 19 that extend transverse to the upper portion 16 such that the extensions 19 engage and rest on the pull up bar 5 (shown in phantom). How far extensions 19 extend outward from the bar engaging portion 16 can be determined by various factors and take into consideration the potential for the accessory to twist if no such extensions were present. For example, the friction coefficient of the material used for this portion, the thickness of the bar, or the compactness of the accessory for mobility purposes are just some examples of such considerations.

In other contemplated embodiments, the portion 18 is molded over (i.e., overmolded) the bar engaging portion 16 to ease in the manufacturing of the accessory. The materials use for portion 18 can, for example, include rubber, silicone, or any other material that increases the friction between the bar and the accessory.

As will be appreciated from the above, a user will "clip" the accessory 10 onto the bar using the hinge member 20. Once the bar 5 is contained within the accessory, the upper portion 16 is positioned on the bar 5 via portion 18 and corresponding extensions 19, and the same is ready for use. When so positioned, the user now can grip handle portion 14 such that their hand is positioned substantially transverse to the bar 5 and do pull ups without putting any unnecessary strain on their forearms or otherwise. When the user is finished with their pull up workout, the accessory is unclipped from the bar via clip 20 and returned to, for example, the user's gym bag.

Figure 2:
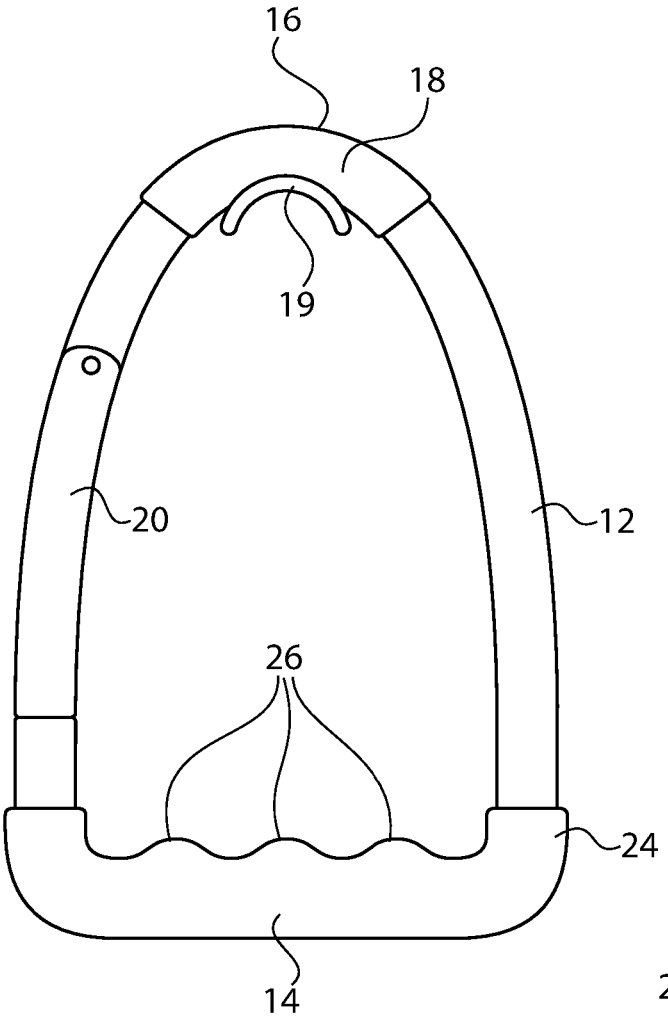
FIG. 2 is a side view of the pull up accessory, according to an embodiment of the invention.

The hand engaging portion 14 can also include a and over-molded rubber 24 having one more or more finger impressions 26 to provide the user with a more comfortable grip (See FIG. 2). The type of material used for the over-molded portion 24 can vary without departing from the intended scope of the present disclosure. For example, different types of silicone, neoprene, or even a canvas or cloth like material could be used. It is preferable that this material be slip resistant at possible.

Figure 3:
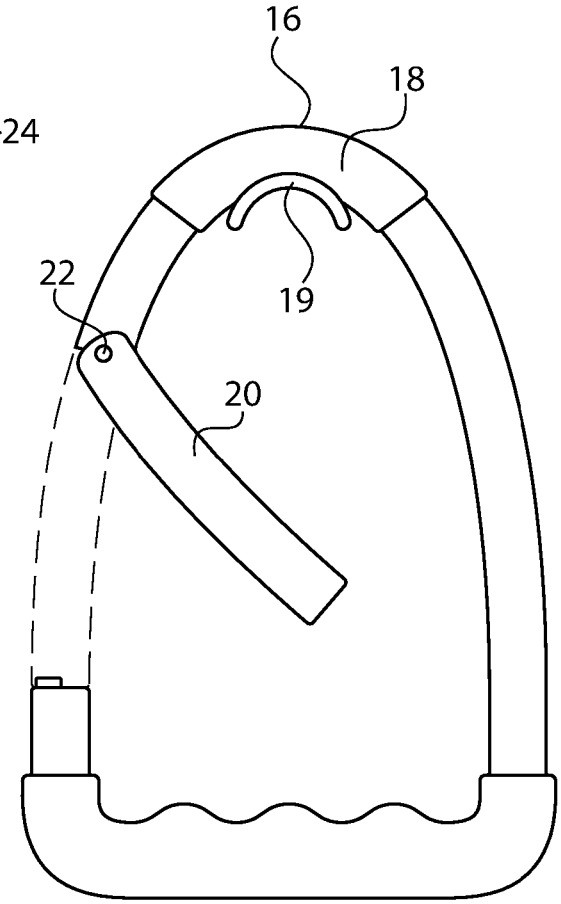
FIG. 3 is another side view of the pull up accessory showing the clip opened, according to an embodiment of the invention.
Figure 4:
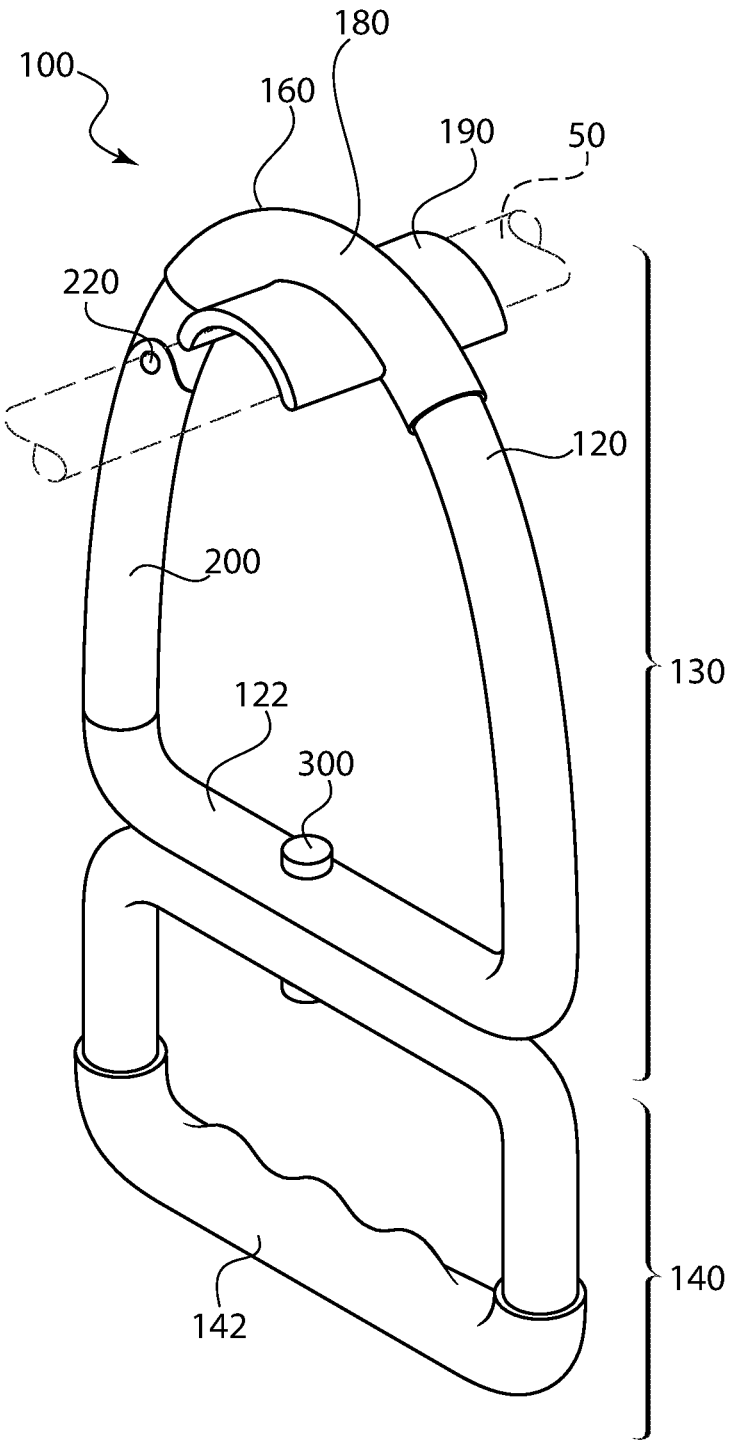
FIG. 4 is a perspective view of the pull up accessory according to another embodiment of the invention.
Figure 5:
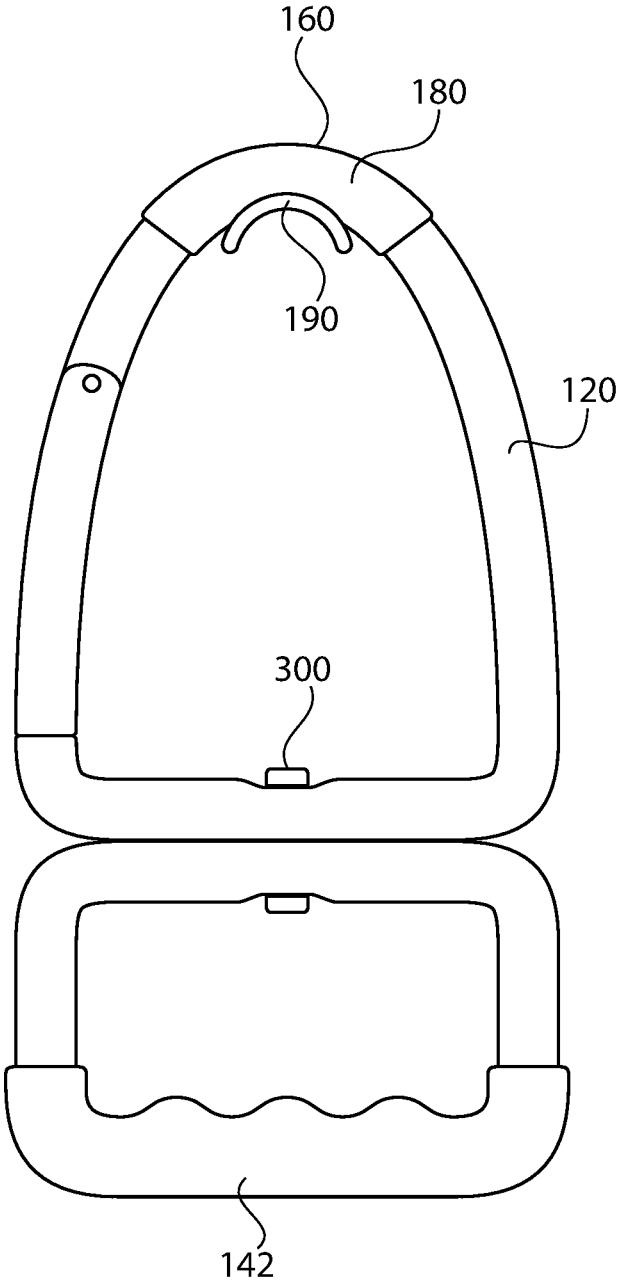
FIG. 5 is a side view of the pull up accessory shown in FIG. 4, according to an embodiment of the invention.
Figure 6:
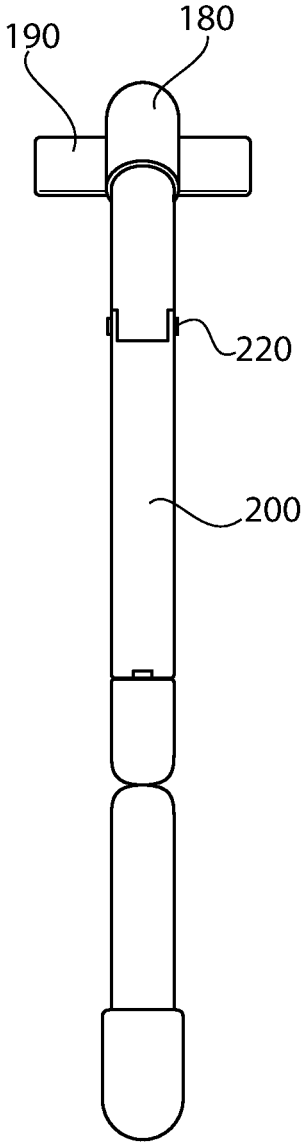
FIG. 6 is a rear view of the pull up accessory shown in FIGS. 4 and 5, according to an embodiment of the invention.
Figure 7:
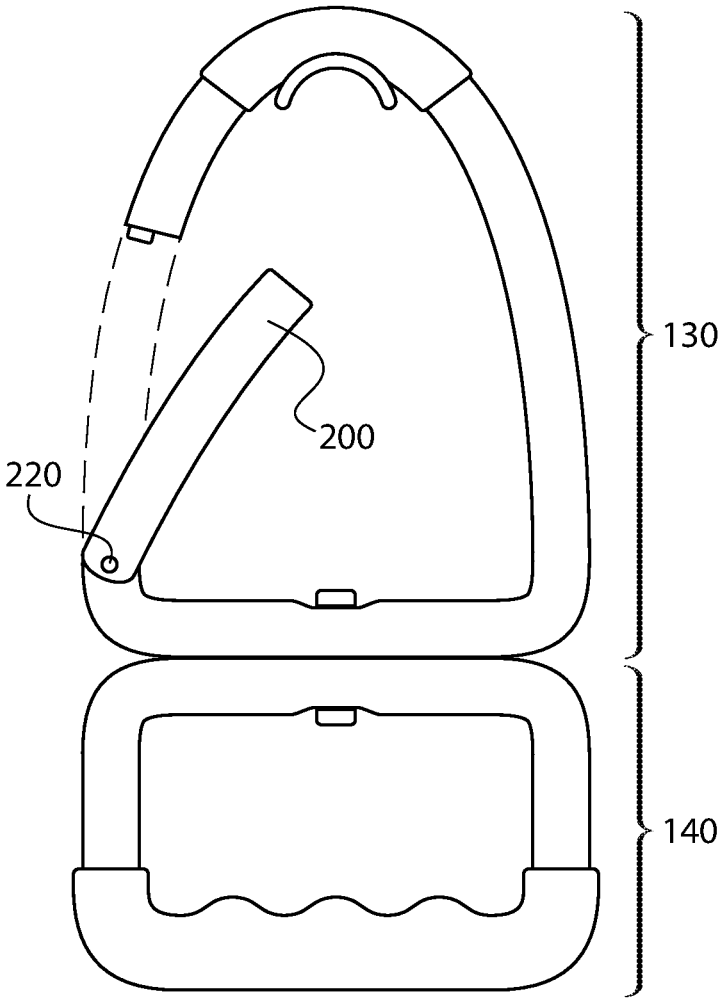
FIG. 7 is another side view of the pull up accessory of FIG. 4 showing the clip opened, according to an embodiment of the invention.

FIGS. 4-12 show another embodiment 100 of the pull up accessory according to the invention. In this implementation, a lower portion 140 is rotatably coupled to an upper portion 130. The upper portion 130 is substantially similar to the embodiment disclose in FIGS. 1-3, with the exception of the hand engaging portion. As shown the accessory 100 includes a lower hand engaging portion 140 rotatably connected to the upper portion 130. The upper bar engaging portion 160 and supports 120 extending from a lower portion 122 to the upper bar engaging portion 160. On one side, the support 120 is made up of a hinge 220 and a hinge member/support 200. The upper bar engaging portion 160 includes a friction increasing/twist preventing portion 180 that has extensions 190 that extend transverse to the upper portion 160 such that the extensions 190 engage and rest on the pull up bar 50 (shown in phantom). How far extensions 190 extend outward from the bar engaging portion 160 can be determined by various factors and take into consideration the potential for the accessory to twist if no such extensions were present. For example, the friction coefficient of the material used for this portion, the thickness of the bar, or the compactness of the accessory for mobility purposes are just some examples of such considerations As mention above, the lower hand engaging portion 140 is rotatably coupled to the lower portion 122 of the upper portion 130 via a rotating means 300. The lower hand engaging portion 140 includes a hand receiving area 142 similar to that of the hand receiving area 14 of the embodiment of FIGS. 1-3.

FIGS. 7A and 7B show the pull up accessory according to two disclosed implementations. Here, the only difference is that the clip 200 and hinge 220 have been changed. By placing the hinge 220 on the bottom as shown in FIG. 7B, the clip 200 would more easily clip onto the bar (not shown), but in either implementation the concepts and principles apply and would clearly be operable.

Figure 8:
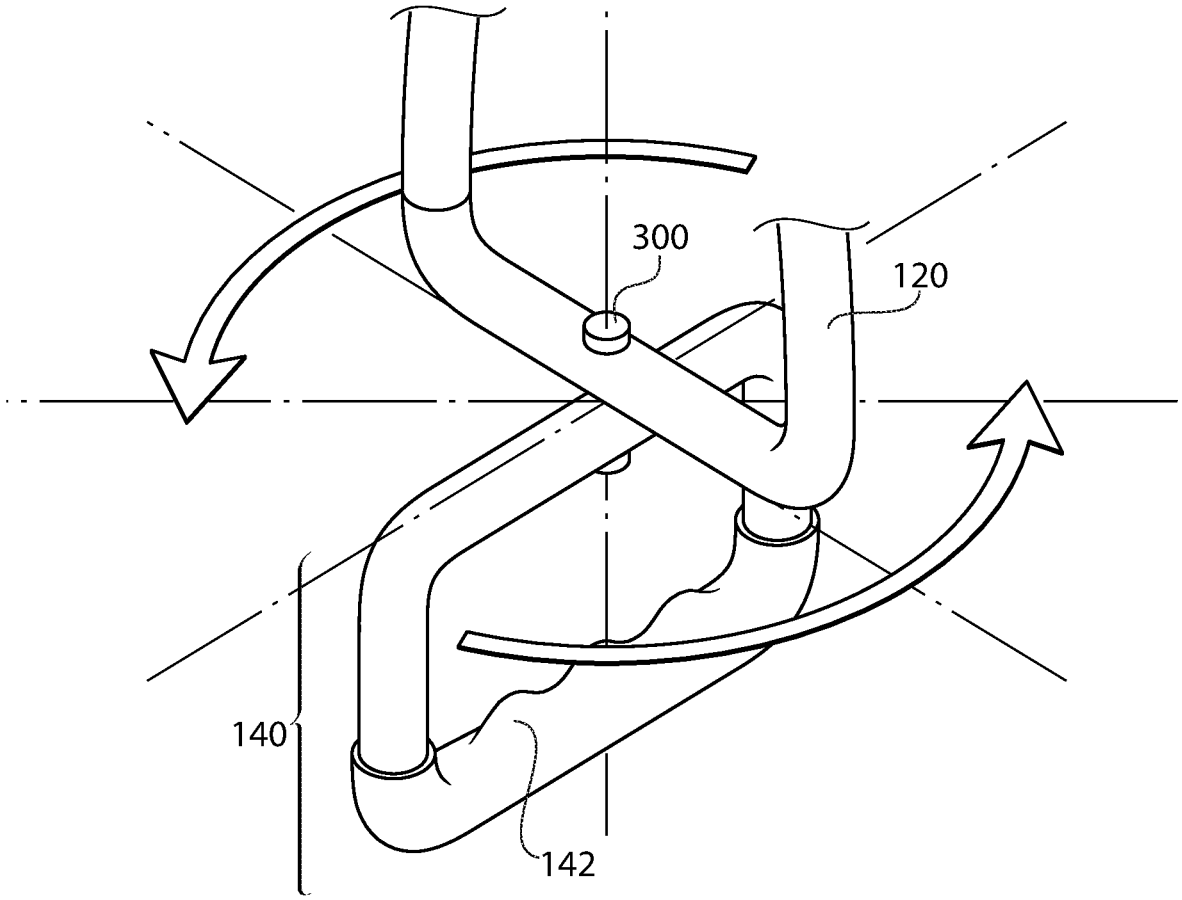
FIG. 8 is a plan view showing the rotating handle portion of the pull up accessory of FIG. 4, according to an embodiment of the invention.
Figure 9:
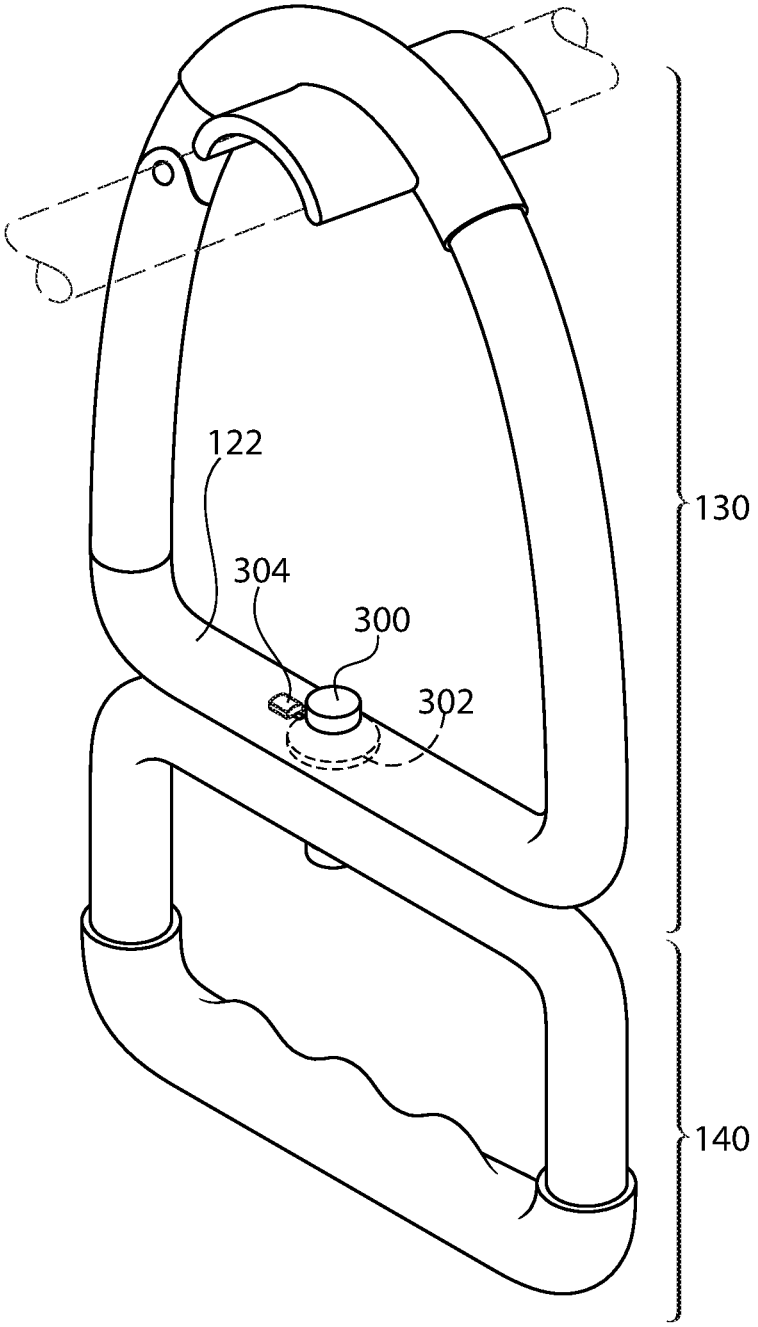
FIG. 9 is a perspective view of the pull up accessory of FIG. 4 showing the locking mechanism for the rotating handle, according to an embodiment of the invention.

FIG. 8 provides a visual of the intended rotation operation of the lower portion 140 about the point or pin 300, in accordance with the present principles. By incorporating a locking rotating mechanism into the pin point 300, the lower portion 140 can be incrementally moved and locked into position. Referring to FIG. 9, a locking rotating mechanism 302 is preferably internal to the cross member 122 and may include a switch or button 304 associated with the same.

Figure 10A:
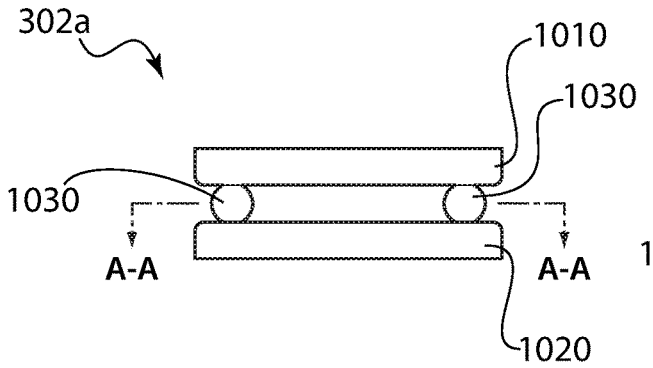
FIG. 10A shows a side view of an indexing system for the rotating handle according to one embodiment of the invention.
Figure 10B:
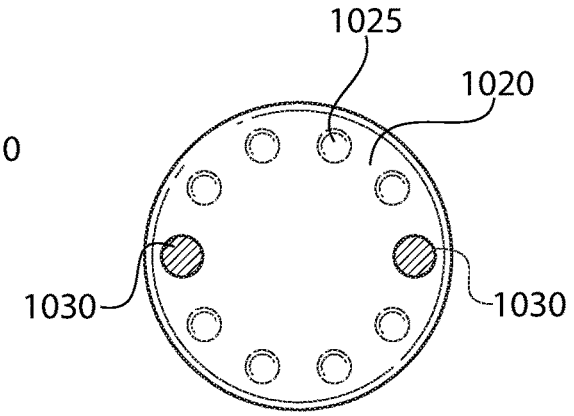
FIG. 10B shows a top view of the indexing system of FIG. 10A, according to an embodiment of the invention.
Figure 11:
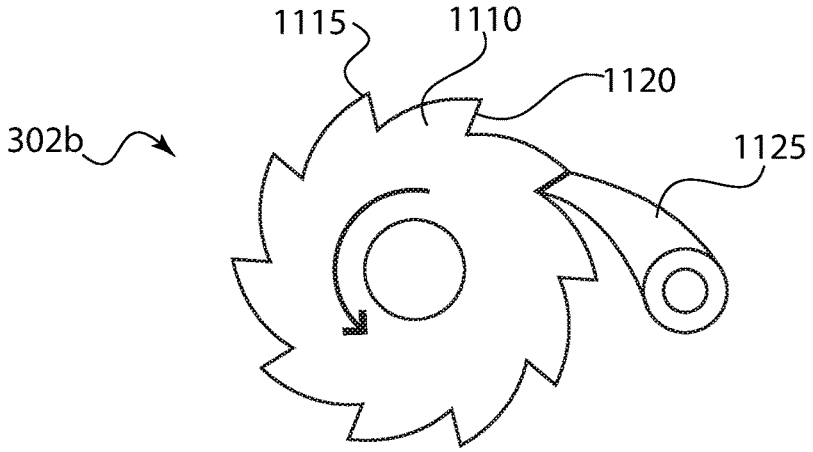
FIG. 11 shows a schematic view of a ratchet mechanism for the rotating handle, according to another embodiment of the invention.
Figure 12:
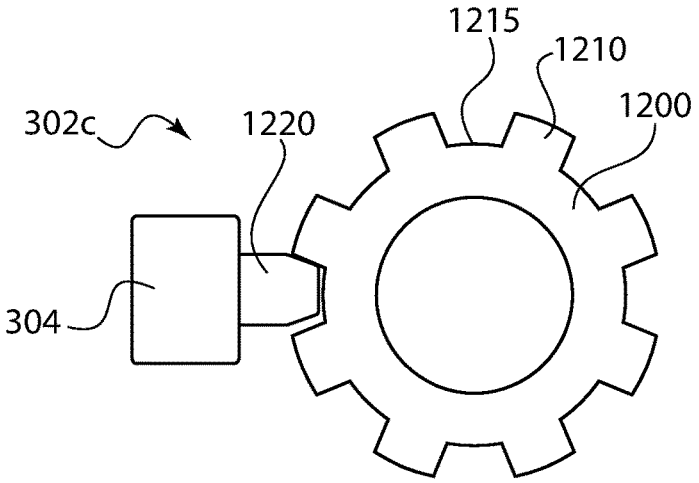
FIG. 12 shows a schematic view of a gear and lock for the rotating handle, according to another embodiment of the invention.

FIGS. 10-12 show some examples of rotating mechanisms 302 that can include automatic or manual indexing capability. For example, referring to FIGS. 10A and 10B, there is shown an indexing system 302A made up of two opposing discs 1010 and 1020. Each disc has holes or indentations 1025. At least one bearing 1030 is provided between the two discs 1010 and 1020 as shown. The holes or indentations 1025 are arranged at predetermined angles such that upon rotation of the lower portion 140, the bearings are forced into the next adjacent hole or indentation. In this manner, the position of the lower handle portion 140 is "indexed" into present angular positions with respect to the upper bar engaging portion. In this implementation, there would be no need for a switch or button 304.

FIG. 11 shows another example of a locking mechanism 302B according to another implementation. Here, the mechanism includes a ratchet like gear 1110 having a plurality of teeth 1115, each having a surface 1120 as shown. The gear rotates in only one direction, and a locking pawl 1125 is configured to lock the gear into position and as against rotation in the other direction.

FIG. 12 shows another example of a locking mechanism 302C according to another implementation. In this implementation the mechanism includes a primary gear 1200 having teeth 1210 and spaces in between the teeth 1215. A locking pawl 1220 is controlled by the button 304 to lock the gear 1200 in a desired position.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A pull up accessory for releasable attachment to a pull up bar comprising:

a bar engaging portion;

a hand engaging portion;

supports connecting the hand engaging portion to the bar engaging portion, at least one of said supports including a releasable clip positioned between the bar engaging portion and the hand engaging portion to enable the pull up accessory to be positioned on the pull up bar;

friction increasing means positioned on the bar engaging portion and configured to increase friction between the bar engaging portion and the pull up bar; and twisting preventing means integrated into the friction increasing means and configured to maintain the bar engaging portion in a position substantially transverse to the pull up bar.

2. The pull up accessory of claim 1, wherein said friction increasing means comprises over-molding a friction increasing substance around the bar engaging portion.

3. The Pull up accessory of claim 2, wherein said twisting preventing means comprises extensions from said bar engaging portion, said extensions being aligned with the bar and engaging the bar for a predetermined distance from the bar engaging portion.

4. A pull up accessory for releasable attachment to a pull up bar comprising:

a single bar engaging portion;

a hand engaging portion;

supports connecting the hand engaging portion to the bar engaging portion, at least one of said supports including a hinge member, the hinge member having a first position where the pull up accessory cannot be removed from or attached to the bar, and a second position where the pull up accessory can be removed from or attached to the bar;

friction increasing means positioned on the bar engaging portion and configured to increase friction between the bar engaging portion and the pull up bar; and twisting preventing means integrated into the friction increasing means and configured to maintain the hand engaging portion in a position.

* * * * *